US011348547B2

(12) United States Patent
Xiong et al.

(10) Patent No.: US 11,348,547 B2
(45) Date of Patent: May 31, 2022

(54) METHOD AND APPARATUS FOR COMPENSATING DISPLAY VOLTAGE, DISPLAY APPARATUS AND DISPLAY DEVICE

(71) Applicants: Hefei BOE Display Technology Co., Ltd., Anhui (CN); BOE TECHNOLOGY GROUP CO., LTD., Beijing (CN)

(72) Inventors: Yulong Xiong, Beijing (CN); Liugang Zhou, Beijing (CN); Tao Li, Beijing (CN); Yizhan Han, Beijing (CN); Jianwei Sun, Beijing (CN); Liu He, Beijing (CN); Yunyun Liang, Beijing (CN)

(73) Assignees: Hefei BOE Display Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 29 days.

(21) Appl. No.: 16/761,593

(22) PCT Filed: Dec. 3, 2019

(86) PCT No.: PCT/CN2019/122684
§ 371 (c)(1),
(2) Date: May 5, 2020

(87) PCT Pub. No.: WO2020/143365
PCT Pub. Date: Jul. 16, 2020

(65) Prior Publication Data

US 2021/0225308 A1 Jul. 22, 2021

(30) Foreign Application Priority Data

Jan. 8, 2019 (CN) ..... 201910016011.1

(51) Int. Cl.
*G09G 3/36* (2006.01)
*G09G 3/00* (2006.01)
*G09G 3/20* (2006.01)

(52) U.S. Cl.
CPC ..... *G09G 3/3614* (2013.01); *G09G 3/006* (2013.01); *G09G 3/2007* (2013.01);
(Continued)

(58) Field of Classification Search
None
See application file for complete search history.

(56) References Cited

U.S. PATENT DOCUMENTS

2008/0170024 A1* 7/2008 Song ..... G09G 3/3648 345/96
2009/0322799 A1* 12/2009 Guo ..... G09G 3/3696 345/690

(Continued)

FOREIGN PATENT DOCUMENTS

CN 101615382 A 12/2009
CN 102654991 A 9/2012

(Continued)

OTHER PUBLICATIONS

Office Action dated Dec. 16, 2019, issued in counterpart CN Application No. 201910016011.1, with English Translation. (29 pages).

(Continued)

*Primary Examiner* — Benjamin C Lee
*Assistant Examiner* — Emily J Frank
(74) *Attorney, Agent, or Firm* — WHDA, LLP

(57) ABSTRACT

The present disclosure provides a method and an apparatus for compensating the display voltage, a display apparatus and a display device, the method comprises acquiring, when performing an inversion operation with a polarity inversion (Continued)

signal for an arbitrary pixel, a preceding grayscale value and a subsequent grayscale value of the pixel, wherein the polarity inversion signal is configured to control the polarity of the pixel voltage of the pixel, the preceding grayscale value is a grayscale value of the pixel in a preceding frame before the inversion operation, and the subsequent grayscale value is the grayscale value of the pixel in a subsequent frame after the inversion operation. A compensated grayscale value is obtained from an inversion compensation table according to the preceding grayscale value and the subsequent grayscale value, wherein the inversion compensation table comprises a mapping relationship among the preceding grayscale value, the subsequent grayscale value and the compensated grayscale value. After displaying the subsequent frame after the inversion operation, the pixel voltage of the arbitrary pixel will be compensated.

4 Claims, 8 Drawing Sheets

(52) U.S. Cl.
CPC ..... *G09G 2320/029* (2013.01); *G09G 2320/0247* (2013.01); *G09G 2320/0626* (2013.01); *G09G 2330/12* (2013.01); *G09G 2360/145* (2013.01); *G09G 2360/16* (2013.01)

(56) References Cited

U.S. PATENT DOCUMENTS

| | | | | |
|---|---|---|---|---|
| 2014/0071184 | A1* | 3/2014 | Lu | G09G 3/3607 345/690 |
| 2014/0152722 | A1 | 6/2014 | Xi et al. | |
| 2016/0063933 | A1* | 3/2016 | Kobayashi | G09G 3/3614 345/691 |
| 2016/0196781 | A1* | 7/2016 | Tanaka | G09G 3/3677 345/691 |
| 2017/0053612 | A1 | 2/2017 | Shin et al. | |
| 2018/0182321 | A1 | 6/2018 | Zeng et al. | |

FOREIGN PATENT DOCUMENTS

| | | | |
|---|---|---|---|
| CN | 103000154 | A | 3/2013 |
| CN | 105551425 | A | 5/2016 |
| CN | 106205536 | A | 12/2016 |
| CN | 106997754 | A | 8/2017 |
| CN | 107452354 | A | 12/2017 |
| CN | 109584831 | A | 4/2019 |

OTHER PUBLICATIONS

Office Action dated Jun. 10, 2020, issued in counterpart CN Application No. 201910016011.1, with English Translation. (27 pages).

* cited by examiner

METHOD AND APPARATUS FOR COMPENSATING DISPLAY VOLTAGE, DISPLAY APPARATUS AND DISPLAY DEVICE

CROSS-REFERENCE TO RELATED APPLICATION(S)

This application is a Section 371 National Stage Application of International Application No. PCT/CN2019/122684, which claims priority to Chinese Application No. 201910016011.1 filed on Jan. 8, 2019, the contents of which are incorporated herein by reference in their entirety.

TECHNICAL FIELD

The present disclosure relates to the display field, in particular, to a method and apparatus for compensating a display voltage, a display apparatus and a display device.

BACKGROUND

In a large-size panel, for example, a panel larger than 65 inches, when a static image is displayed for a long time, a bias voltage will be generated on the pixels, which is likely to cause afterimage. In order to improve the afterimage, the polarity inversion (POL) signal of the pixel is usually inverted once at a preset time interval, so that the bias voltage on the pixel may be offset. However, when the pixel voltage of the two frames before and after the inversion operation have the same polarities, the liquid crystal will deflect in the same direction, making the deflection angle of the liquid crystal in the subsequent frame too large, causing the liquid crystal to be overdriven, resulting in the difference in brightness of the preceding and subsequent frames, and further causing the screen to flicker.

SUMMARY

The present disclosure provides a method and an apparatus for compensating a display voltage, a display apparatus, and a display device.

According to an aspect of the present disclosure, there is provided a method for compensating a display voltage, comprising: acquiring, when performing an inversion operation with a polarity inversion signal for an arbitrary pixel, a preceding grayscale value and a subsequent grayscale value of the pixel. Among others, the polarity inversion signal is configured to control the polarity of the pixel voltage of the pixel, the preceding grayscale value is a grayscale value of the pixel in a preceding frame before the inversion operation, and the subsequent grayscale value is the grayscale value of the pixel in a subsequent frame after the inversion operation. Then, a compensated grayscale value is obtained from an invention compensation table, according to the preceding grayscale value and the subsequent grayscale value discussed above. Among others, the inversion compensation table comprises a mapping relationship among the preceding grayscale value, the subsequent grayscale value and the compensated grayscale value discussed above. Next, when displaying the subsequent frame after the inversion operation, a pixel voltage of the pixel is compensated according to the compensated grayscale value.

For example, the method for compensating the display voltage discussed above further comprises constructing the inversion compensation table, before obtaining the compensated grayscale value from the inversion compensation table according to the preceding grayscale value and the subsequent grayscale value.

For example, constructing the inversion compensation table comprises constructing a first inversion compensation table. Constructing a first inversion compensation table comprises: detecting a standard brightness to which the preceding grayscale value is directed; and detecting the display brightness to which a subsequent grayscale value is directed. Then, the display brightness is compared with the standard brightness. When the display brightness is greater than the standard brightness, the subsequent grayscale value is reduced so as to consider a reduced subsequent grayscale value as the compensated grayscale value, wherein the display brightness to which the compensated grayscale value is directed is less than or equal to the standard brightness. Next, the first inversion compensation table is constructed according to the preceding grayscale value, the subsequent grayscale value and the compensated grayscale value.

For example, detecting a standard brightness to which the preceding grayscale value is directed comprises: displaying the pixel according to the preceding grayscale value. The display brightness of the pixel is detected to be considered as the standard brightness to which the preceding grayscale value is directed.

For example, detecting the display brightness to which the subsequent grayscale value is directed comprises: performing a test inversion operation on the polarity inversion signal. Then, the pixel in the subsequent frame after the test inversion operation is displayed according to the subsequent grayscale value. Next, the display brightness of the pixel in the subsequent frame after the test inversion operation is detected, and the display brightness obtained after the test inversion operation is considered as the display brightness to which the subsequent grayscale value is directed.

For example, reducing, when the display brightness is greater than the standard brightness, the subsequent grayscale value so as to obtain the compensated grayscale value comprises: repeating the reducing, when the display brightness is greater than the standard brightness, until the display brightness to which a reduced subsequent grayscale value is smaller than or equal to the standard brightness. Further, the reduced subsequent grayscale value is considered as the compensated grayscale value, when the display brightness to which the reduced subsequent grayscale value is directed is smaller than or equal to the standard brightness. Repeating the reducing comprises: reducing the subsequent grayscale by a specified threshold value, and detecting the display brightness to which a reduced subsequent grayscale value is directed. Then, the display brightness to which the reduced subsequent grayscale value is directed is compared with the standard brightness.

For example, constructing the inversion compensation table comprises constructing a second inversion compensation table. Constructing the second inversion compensation table comprises: on one hand, obtaining a first preceding grayscale value and a first subsequent grayscale value which are the same. A first standard brightness to which the first preceding grayscale value is directed and a first display brightness to which the first subsequent grayscale value is directed are detected respectively. Then, the first display brightness is compared with the first standard brightness. When the first display brightness is greater than the first standard brightness, the first subsequent grayscale value is reduced, and a reduced first subsequent grayscale value is considered as a first compensated grayscale value, wherein the display brightness to which the first compensated grayscale value is directed is less than or equal to the first standard brightness. On the other hand, obtaining a second preceding grayscale value and a second subsequent grayscale value which are the same. A second standard brightness to which the second preceding grayscale value is directed and a second display brightness to which the second subsequent grayscale value is directed are detected respectively. Then, the second display brightness is compared with the second standard brightness. When the second display brightness is greater than the second standard brightness, the second subsequent grayscale value is reduced, and a reduced second subsequent grayscale value is considered as a second compensated grayscale value, wherein the display brightness to which the second compensated grayscale value is directed is less than or equal to the second standard brightness. Then, a third compensated grayscale value for the first preceding grayscale value and the second subsequent grayscale value is calculated, according to the first preceding grayscale value, the first compensated grayscale value, the second subsequent grayscale value and the second compensated grayscale value. Then, the second inversion compensation table is constructed according to the first preceding grayscale value, the second subsequent grayscale value and the third compensated grayscale value.

For example, calculating a third compensated grayscale value according to the first preceding grayscale value, the first compensated grayscale value, the second subsequent grayscale value and the second compensated grayscale value comprises: calculating the third compensated grayscale value by using linear interpolation method according to the first preceding grayscale value, the first compensated grayscale value and the second compensated grayscale value.

For example, the method discussed above further comprises: before obtaining the compensated grayscale value from the inversion compensation table according to the preceding grayscale value and the subsequent grayscale value, receiving the polarity inversion signal, and entering into a polarity inversion compensation mode in response to the polarity inversion signal.

According to another aspect of the present disclosure, there is provided an apparatus for compensating a display voltage comprising: a polarity inversion module, configured to perform an inversion operation with a polarity inversion signal for an arbitrary pixel; a compensating grayscale acquisition module, configured to acquire a preceding grayscale value and a subsequent grayscale value of the pixel, wherein the polarity inversion signal is configured to control the polarity of the pixel voltage of the pixel, the preceding grayscale value is a grayscale value of the pixel in a preceding frame before the inversion operation, and the subsequent grayscale value is the grayscale value of the pixel in a subsequent frame after the inversion operation, and to acquire a compensated grayscale value from an inversion compensation table according to the preceding grayscale value and the subsequent grayscale value, wherein the inversion compensation table comprises a mapping relationship among the preceding grayscale value, the subsequent grayscale value and the compensated grayscale value; a compensating module, coupled to the compensating grayscale acquisition module and configured to compensate, when displaying the subsequent frame, a pixel voltage of the pixel according to the compensated grayscale value.

For example, the apparatus for compensating the display voltage further comprises: a storage module, coupled to the compensating grayscale acquisition module and configured to store the inversion compensation table.

For example, the apparatus for compensating the display voltage further comprises: a control module, configured to receive a polarity control signal and control the compensating grayscale acquisition module to acquire the compensated grayscale value in response to the polarity control signal.

According to yet another aspect of the present disclosure, there is provided a display apparatus comprising the apparatus for compensating the display voltage discussed above.

According to still another aspect of the present disclosure, there is provided a display device comprising a memory and at least one processor. The memory is configured to store instructions. The at least one processor is configured to execute instructions stored in the memory, so as to implement the method for compensating the display voltage discussed above.

It should be understood that the above general description and the following detailed description are only exemplary and explanatory, and do not limit the present disclosure.

BRIEF DESCRIPTION OF THE DRAWINGS

The above and other features and advantages of the present disclosure will become more apparent by describing example embodiments thereof in detail with reference to the drawings.

DETAILED DESCRIPTION

Figure 1:
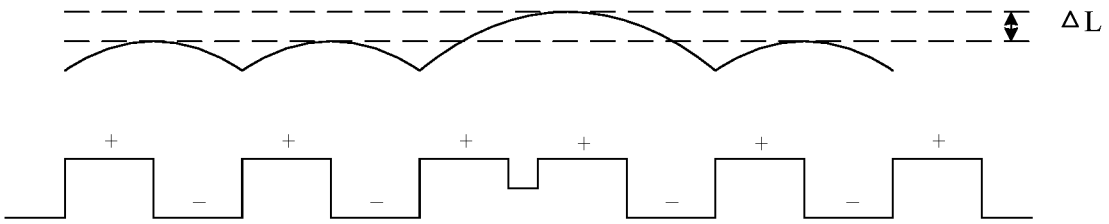
FIG. 1 is a schematic diagram of display brightnesses before and after an inversion operation.

Example embodiments will now be described more fully with reference to the drawings. However, the exemplary embodiments can be implemented in various forms, and should not be construed as being limited to the embodiments set forth herein. On the contrary, these embodiments is provided such that the present disclosure will be comprehensive and complete, and the idea of the exemplary embodiments is fully conveyed to those skilled in the art. The same reference numerals in the drawings denote the same or similar parts, and thus their repeated description will be omitted.

Furthermore, the described features, structures, or characteristics may be combined in one or more embodiments in any suitable manner. In the following description, many specific details are provided to give a full understanding of the embodiments of the present disclosure. However, those skilled in the art will realize that the technical solutions of the present disclosure may be practiced without one or more of the specific details, or other methods, components, materials, devices, steps, etc. may be used. In other instances, well-known structures, methods, devices, implementations, materials, or operations have not been shown or described in detail to avoid obscuring aspects of the present disclosure.

The block diagrams shown in the drawings are merely functional entities and do not necessarily have to correspond to physically independent entities. That is, these functional entities may be implemented in the form of software, or implemented in one or more software-hardened modules, or in different networks and/or processor devices and/or microcontroller devices.

In addition, in the description of the embodiments of the present disclosure, unless otherwise defined, the technical or scientific terms used in the present disclosure should be generally understood by those skilled in the field to which the present disclosure belongs. The terms such as "first", "second" and similar words used in this disclosure do not indicate any order, quantity or importance, but are only used to distinguish different components. Similarly, words like "a", "an" or "the" do not mean any quantity limitation, but mean that there is at least one. Similar words such as "comprise" or "include" mean that the elements or objects appearing before the word cover the elements or components listed after the word and their equivalents, but do not exclude other elements or components.

Under normal circumstances, large-size 4K display panels, such as TV panels larger than 65 inches, the bias voltages of the positive and negative polarities applied to the pixels cannot be offset. Since the static picture is displayed for a long time, there will be an equivalent positive or negative bias voltage on the pixel, which will cause an afterimage. In order to improve the afterimage, for example, the inversion operation is usually performed with respect to the POL signal every 28 seconds, so that the bias voltages before and after the inversion operation offset with each other, and the equivalent DC voltage on the liquid crystal is zero, thereby improving the afterimage. This method can be referred to as "28 seconds polarity inversion". As shown in FIG. 1, the inversion operation is performed every 28 seconds. The pixel voltages of the two frames before and after the inversion operation have the same polarity, and the liquid crystal is deflected in the same direction, wherein the deflection angle of the liquid crystal for the subsequent frame after the inversion operation is larger. This is expressed as a brightness gain of $\Delta L$ of the subsequent frame, causing a higher brightness. There is a difference between the brightnesses of the preceding frame and subsequent frame under the static screen, which causes the screen to flicker once, affecting the picture quality.

In order to solve the above problem, one way is to charge normally with respect to the preceding frame before the inversion operation, and reduce the charging time with respect to the subsequent frame after the inversion operation, so as to decrease the deflection angle of the liquid crystal in the subsequent frame and the overdriving effect of the liquid crystal in the subsequent frame. This method has two disadvantages that: first, since the voltage is turned on line by line, it is easy to cause insufficient charging in the next frame, too much brightness reduction, and the overall brightness being lower than the preceding frame, and result in flickering. Secondly, for large-size TV panels, the distal end circuit has a large load, which is likely to cause insufficient charging at the distal end, well charging at the near end, and a large difference between the brightnesses at the distal and near ends. This results in the brightness at the distal end of the subsequent frame lower than the brightness at the same position of the preceding frame by a large amount and the brightness at the near end of the subsequent frame lower than the brightness at the same position of the preceding frame by a small amount. This may cause flickering at the distal end.

Figure 2:
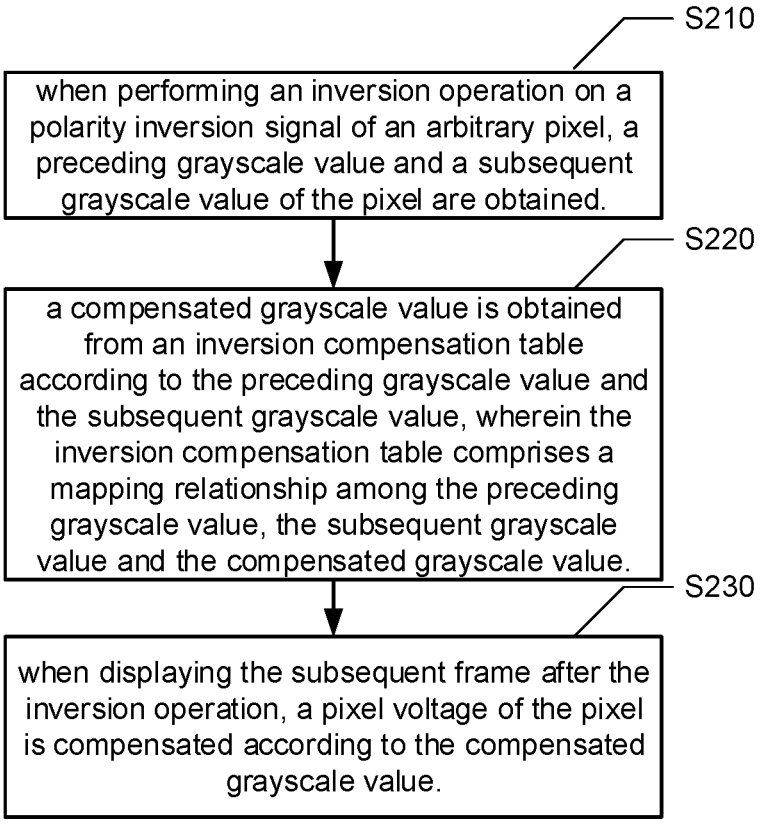
FIG. 2 is a flowchart illustrating a method for compensating a display voltage according to an embodiment of the present disclosure.

Firstly, exemplary embodiments of the present disclosure provide a method for compensating a display voltage. It should be noted that the sequence number of respective steps in the following method is only used as a representation of the steps for description, and should not be regarded as representing the execution order of the respective steps. Unless explicitly stated, the method is not required to be implemented in the exact order shown. As shown in FIG. 2, the method for compensating the display voltage may comprise the following steps.

In step S210, when performing an inversion operation with a polarity inversion signal for an arbitrary pixel, a preceding grayscale value and a subsequent grayscale value of the pixel are obtained.

In step S220, a compensated grayscale value is obtained from an inversion compensation table according to the preceding grayscale value and the subsequent grayscale value, wherein the inversion compensation table comprises a mapping relationship among the preceding grayscale value, the subsequent grayscale value and the compensated grayscale value.

In step S230, when displaying the subsequent frame after the inversion operation, a pixel voltage of the pixel is compensated according to the compensated grayscale value.

Among others, the polarity inversion signal is configured to control the polarity of the pixel voltage of the arbitrary pixel. The preceding grayscale value is a grayscale value of the arbitrary pixel in a preceding frame before the inversion operation, and the subsequent grayscale value is the grayscale value of the arbitrary pixel in a subsequent frame after the inversion operation, that is, a theoretical grayscale value to be displayed by the arbitrary pixel in the subsequent frame of the inversion operation, and the compensated grayscale value is the actual display grayscale value that enables the display brightness of the screen before and after the inversion operation to be stable during the actual displaying without flickering.

The display compensation method of the embodiments of the present disclosure obtains the compensated grayscale value from the invention compensation table according to the preceding grayscale value and the subsequent grayscale value, and compensates the pixel voltage of the arbitrary pixel by compensating the grayscale value, thereby mitigating the problem that there is a difference between the screen brightnesses before and after the inversion operation of a static screen due to the liquid crystal overdriving when the polarities of the pixel voltages are the same in two frames before and after the inversion operation, causing the screen flickering issue. Further, because there is no change in the charging time, there will not be a problem of flickering at the distal end which is caused by insufficient charging at the distal end and well charging at the near end of the large-size panel as discussed in the method described above, improving the display quality.

Figure 3:
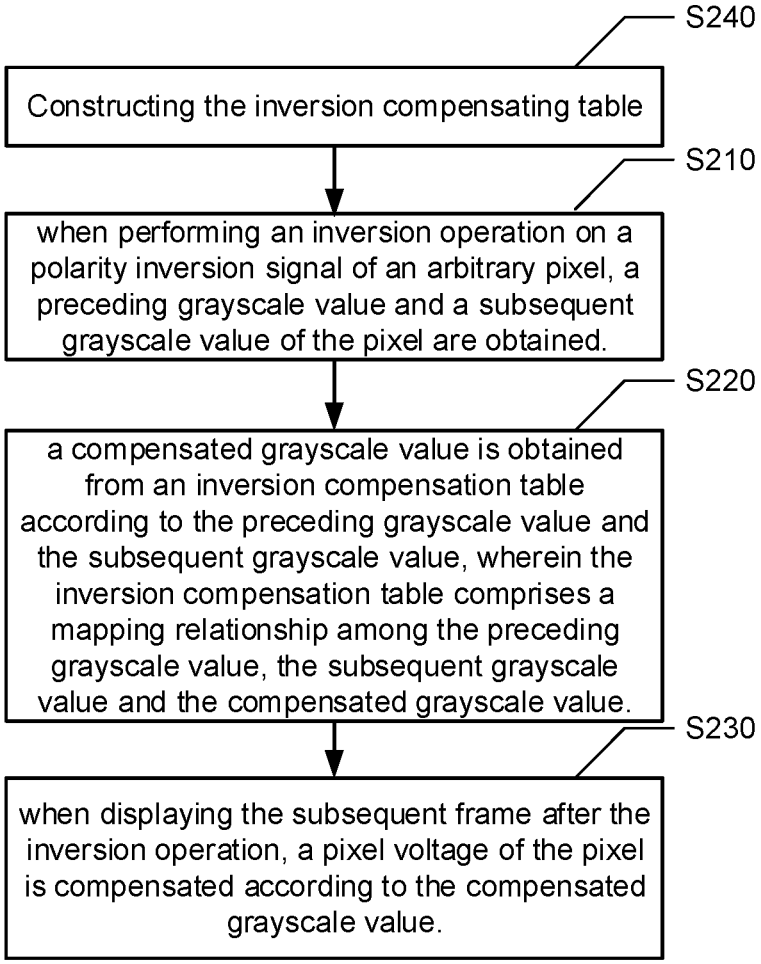
FIG. 3 is a flowchart illustrating a method for compensating a display voltage according to another embodiment of the present disclosure.
Figure 4:
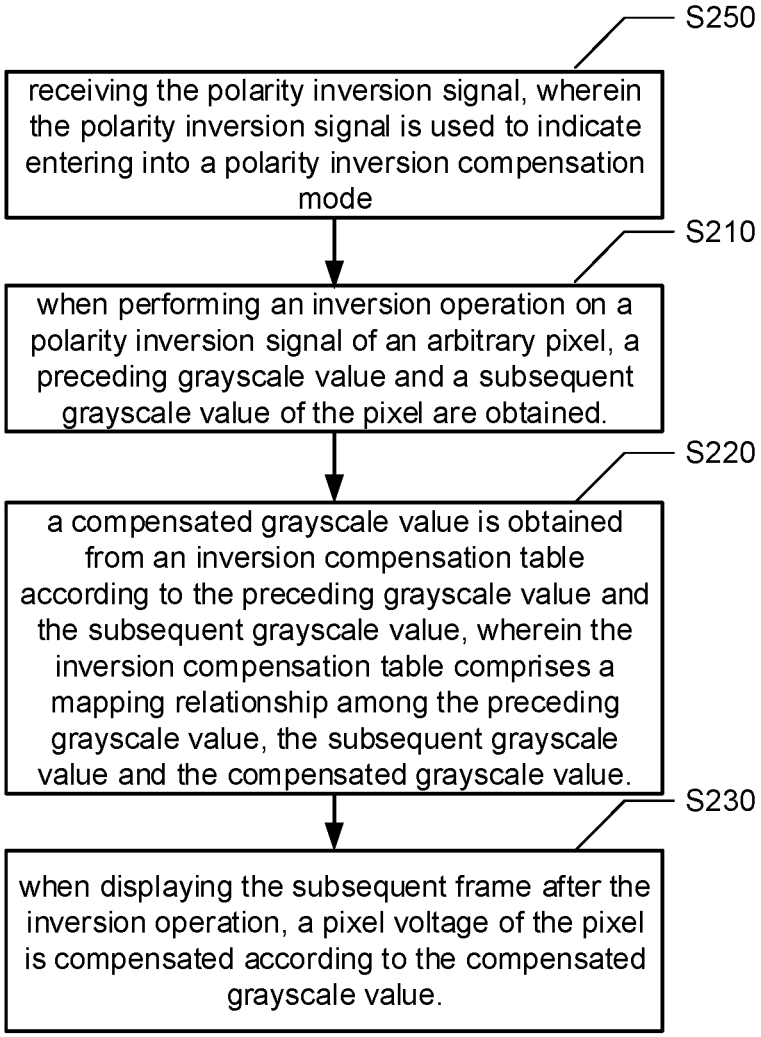
FIG. 4 is a flowchart illustrating a method for compensating a display voltage according to yet another embodiment of the present disclosure.

Further, as shown in FIG. 3, before step S210, the above method for compensating the display voltage may further comprise step S240.

In step S240, an inversion compensation table is constructed.

Among others, constructing the inversion compensation table comprises constructing a mapping relationship among the preceding grayscale value, the subsequent grayscale value and the compensated grayscale value. The mapping relationship among the preceding grayscale value, the subsequent grayscale value and the compensated grayscale value may be obtained experimentally.

For example, the mapping relationship among the preceding grayscale value, the subsequent grayscale value and the compensated grayscale value can be obtained by using a light sensor and an oscilloscope. In the example, the test inversion operation is performed on the polarity inversion signal. The screen brightness signals before and after the test inversion operation are both detected via the light sensor, then converted into an electrical signal, and inputted into an electrical signal input filter. The display brightness of the preceding frame and the subsequent frame of the test inversion operation are obtained via the filter. If the display brightness to which the subsequent frame after the test inversion operation is directed is greater than the standard brightness, the subsequent grayscale value is reduced until the display brightness to which the reduced subsequent grayscale value is directed is less than or equal to the standard brightness. At this time, the reduced subsequent grayscale value is the compensated grayscale value.

In a feasible implementation according to the embodiments of the present disclosure, in step S240, constructing the inversion compensation table may comprise: constructing a first inversion compensation table.

For example, constructing the first inversion compensation table may comprise: detecting the standard brightness to which the preceding grayscale value is directed, and detecting the display brightness to which the subsequent grayscale value is directed. Then, the display brightness is compared with the standard brightness. When the display brightness is greater than the standard brightness, the subsequent grayscale value is reduced so as to obtain the compensated grayscale value. Among others, the display brightness to which the compensated grayscale value is directed is less than or equal to the standard brightness. Next, the first inversion compensation table is constructed according to the preceding grayscale value, the subsequent grayscale value and the compensated grayscale value.

Figure 5:
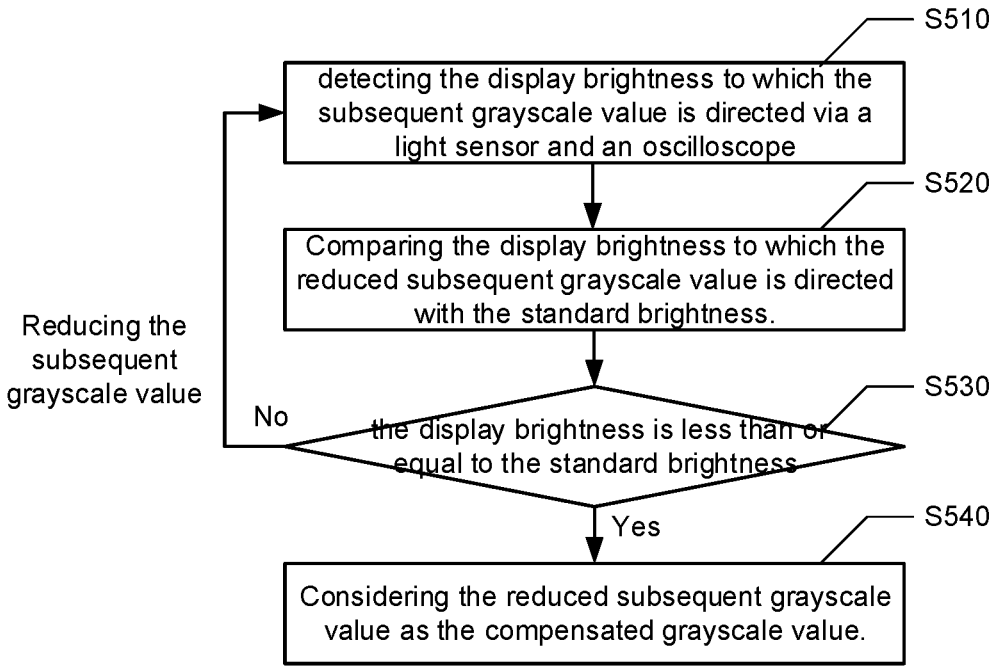
FIG. 5 is a flowchart illustrating a method for determining a compensated grayscale value according to an embodiment of the present disclosure.

For example, as shown in FIG. 5, determining the compensated grayscale value may comprise: in step S510, detecting the display brightness to which the subsequent grayscale value is directed via a light sensor and an oscilloscope. In step S520, the display brightness to which the reduced subsequent grayscale value is directed is compared with the standard brightness. In step S530, it is determined that whether the display brightness is less than or equal to the standard brightness. When the display brightness is smaller than or equal to the standard brightness, step S540 is performed, in which the reduced subsequent grayscale value is considered as the compensated grayscale value. When the display brightness is greater than the standard brightness, the subsequent grayscale value is reduced, the display brightness to which the reduced subsequent grayscale value is directed is re-detected, and the display brightness is compared with the standard brightness, until the brightness to which the reduced subsequent grayscale value is directed is smaller than or equal to the standard brightness. At this time, the reduced subsequent grayscale value corresponding to the display brightness is considered as the compensated grayscale value. The standard brightness may refer to the ideal display brightness expected under a condition with the preceding grayscale value and the subsequent grayscale value.

For example, detecting a standard brightness to which the preceding grayscale value is directed may comprise: displaying the arbitrary pixel according to the preceding grayscale value. The display brightness of the arbitrary pixel is detected via the light sensor and the oscilloscope, to be considered as the standard brightness to which the preceding grayscale value is directed. The above-mentioned detection of the display brightness for the subsequent grayscale value comprises: performing a test inversion operation on the polarity inversion signal. Then, the pixel in the subsequent frame after the test inversion operation is displayed according to the subsequent grayscale value. Next, the display brightness of the pixel in the subsequent frame after the test inversion operation is detected via the light sensor and the oscilloscope, to be considered as the display brightness to which the subsequent grayscale value is directed.

According to the embodiments of the present disclosure, when the display brightness to which the subsequent grayscale value is directed is greater than the standard brightness, reducing the subsequent grayscale value to obtain the compensated grayscale value may comprises: when the display brightness is greater than the standard brightness, repeating the reducing until the display brightness to which a reduced subsequent grayscale value is directed is smaller than or equal to the standard brightness. Further, the reduced subsequent grayscale value is considered as the compensated grayscale value, when the display brightness to which the reduced subsequent grayscale value is directed is smaller than or equal to the standard brightness. Among others, repeating the reducing comprises reducing the subsequent grayscale by a specified threshold value, and detecting the display brightness to which a reduced subsequent grayscale value is directed. Then, the display brightness to which the reduced subsequent grayscale value is directed is compared with the standard brightness. The process of detecting the display brightness to which the subsequent grayscale value after each reduction is the same as the above process for detecting the display brightness to which the subsequent grayscale value is directed, which will not be repeated here.

Before and after the test inversion operation, when the grayscale value of a pixel changes from the preceding grayscale value to the subsequent grayscale value, the display brightness is detected from the subsequent grayscale value. If the display brightness is less than or equal to the standard brightness, the subsequent grayscale value will be used as the compensated grayscale value. If the display brightness is greater than the standard brightness, the subsequent grayscale value will be reduced by a specified threshold so as to continue the detection and comparison until the display brightness is less than or equal to the standard brightness. Among others, the specified threshold may be a level of grayscale value or levels of grayscale value.

For example, when the front grayscale value is 127 and the static screen is displayed, then the subsequent grayscale value is 127. The display brightness to which the 127 grayscale value is directed after the test inversion operation is detected, and compared with the standard brightness, wherein the standard brightness is the display brightness to which the 127 grayscale value is directed before the test inversion operation. After testing, when the subsequent grayscale value is 127, the display brightness is greater than the standard brightness. Thus, the subsequent grayscale value is reduced to 126. At this time, it is detected that the display brightness for the 126 grayscale value after the test inversion operation is less than the standard brightness. Thus, the compensated grayscale value is 126.

In the case, the compensated grayscale value for each preceding grayscale value and its corresponding subsequent grayscale value can be obtained, and the pixel voltage of the corresponding pixel can be compensated by the compensated grayscale value. The compensated grayscale value obtained in this way is accurate and thus compensates the pixel voltage of the pixel more accurately, contributing in improving the display quality.

In another feasible implementation according to the embodiments of the present disclosure, constructing the inversion compensation table in step S240 may comprise: constructing a second inversion compensation table.

For example, the above construction of the second inversion compensation table may comprise a first process, a second process and a third process.

During the first process, a first preceding grayscale value and a first subsequent grayscale value are obtained, wherein the first preceding grayscale value and the first subsequent grayscale value are the same. A first standard brightness to which the first preceding grayscale value is directed and a first display brightness to which the first subsequent grayscale value is directed are detected respectively. Then, the first display brightness is compared with the first standard brightness. When the first display brightness is greater than the first standard brightness, the first subsequent grayscale value is reduced so as to obtain a first compensated grayscale value, wherein the display brightness to which the first compensated grayscale value is directed is less than or equal to the first standard brightness.

During the second process, a second preceding grayscale value and a second subsequent grayscale value are obtained, wherein the second preceding grayscale value and the second subsequent grayscale value are the same. A second standard brightness to which the second preceding grayscale value is directed and a second display brightness to which the second subsequent grayscale value is directed are detected respectively. Then, the second display brightness is compared with the second standard brightness. When the second display brightness is greater than the second standard brightness, the second subsequent grayscale value is reduced so as to obtain a second compensated grayscale value, wherein the display brightness to which the second compensated grayscale value is directed is less than or equal to the second standard brightness.

During the third process, a third compensated grayscale value is calculated according to the first preceding grayscale value, the second subsequent grayscale value, the first compensated grayscale value and the second compensated grayscale value. Among others, the first subsequent grayscale value and the second subsequent grayscale value are different, and the third compensated grayscale value is the compensated grayscale value for the arbitrary pixel when its grayscale value changes from the first preceding grayscale value of the preceding frame to the second subsequent grayscale value of the subsequent frame in the inversion operation. Then, the second inversion compensation table is constructed according to the first preceding grayscale value, the second subsequent grayscale value and the third compensated grayscale value.

For example, in the preceding frame of the inversion operation, one pixel is displayed with the first preceding grayscale value. When displaying the static screen, in the subsequent frame after the test inversion operation, the theoretical grayscale value of the one pixel is the first subsequent grayscale value, i.e. a grayscale value being the same with the first preceding grayscale value. Similarly, in the preceding frame of the inversion operation, another pixel is displayed with the second preceding grayscale value. When displaying the static screen, in the subsequent frame after the test inversion operation, the theoretical grayscale value of the other pixel is the second subsequent grayscale value, i.e. a grayscale value being the same with the second preceding grayscale value. When the screen displayed before and after the test inversion operation changes, the preceding grayscale values and the subsequent grayscale value of the same pixel before and after the test inversion operation are different from each other. For example, when the display grayscale of one pixel in the preceding frame before the test inversion operation is the first preceding grayscale value and the theoretical grayscale value of the one pixel in the subsequent frame after the test inversion operation is the second subsequent grayscale value, the third compensated grayscale value is calculated according to the first preceding grayscale value, the second subsequent grayscale value, the first compensated grayscale value and the second compensated grayscale value.

For example, the display brightnesses to which the first subsequent grayscale value and the second subsequent grayscale value are detected via the light sensor and the oscilloscope. The first display brightness corresponding to the first subsequent grayscale value is compared with the first standard brightness. When the first display brightness is less than or equal to the first standard brightness, the first subsequent grayscale value is used as the first compensated grayscale. When the first display brightness is greater than the first standard brightness, the first subsequent grayscale value is reduced. The display brightness corresponding to the reduced grayscale is detected, and compared with the first standard brightness until the display brightness is less than or equal to the first standard brightness. At this time, the grayscale value corresponding to the display brightness is considered as the first compensated grayscale. Similarly, the second compensated grayscale can also be obtained by the above method. The first standard brightness may refer to the ideal display brightness expected under a condition with the first preceding grayscale value and the first subsequent grayscale value, And the second standard brightness may refer to the ideal display brightness expected under a condition with the second preceding grayscale value and the second subsequent grayscale value.

Table 1 is an inversion compensation table according to an exemplary embodiment of the present disclosure. As shown in Table 1, the first compensated grayscale value is the grayscale value at the diagonal line in the figure, wherein the first subsequent grayscale value is the same as the first preceding grayscale value, and the display screen is a static screen. In the static picture, the display brightness to which the first subsequent grayscale value is directed in the subsequent frame after the test inversion operation is detected, and compared with the standard brightness. If the display brightness is less than or equal to the standard brightness, the first subsequent grayscale value will be used as the compensated grayscale value. If the display brightness is greater than the standard brightness, the first subsequent grayscale value will be reduced by a specified threshold, and the detection and comparison continues until the display brightness is less than or equal to the standard brightness. Among others, the specified threshold may be a level of grayscale value or levels of grayscale value.

TABLE 1

Inversion Compensating Table

| | 0 | 8 | 16 | 32 | 48 | 64 | 80 | 96 | 112 | 128 | 144 | 160 | 176 | 192 | 208 | 224 | 240 | 248 | 255 |
|---|---|---|---|---|---|---|---|---|---|---|---|---|---|---|---|---|---|---|---|
| 0 | 0 | | | | | | | | | | | | | | | | | | |
| 8 | | 7 | | | | | | | | | | | | | | | | | |
| 16 | | | 15 | | | | | | | | | | | | | | | | |
| 32 | | | | 31 | | | | | | | | | | | | | | | |
| 48 | | | | | 47 | | | | | | | | | | | | | | |
| 64 | | | | | | 63 | | | | | | | | | | | | | |
| 80 | | | | | | | 79 | | | | | | | | | | | | |
| 96 | | | | | | | | 95 | | | | | | | | | | | |
| 112 | | | | | | | | | 111 | | | | | | | | | | |
| 128 | | | | | | | | | | 126 | | | | | | | | | |
| 144 | | | | | | | | | | | 142 | | | | | | | | |
| 160 | | | | | | | | | | | | 158 | | | | | | | |
| 176 | | | | | | | | | | | | | 174 | | | | | | |
| 192 | | | | | | | | | | | | | | 189 | | | | | |
| 208 | | | | | | | | | | | | | | | 206 | | | | |
| 224 | | | | | | | | | | | | | | | | 222 | | | |
| 240 | | | | | | | | | | | | | | | | | 239 | | |
| 248 | | | | | | | | | | | | | | | | | | 247 | |
| 255 | | | | | | | | | | | | | | | | | | | 255 |

It should be noted that the first row in Table 1 can represent the preceding grayscale values, and the first column can represent the subsequent grayscale values. The table comprises the compensated grayscale values. The data along the diagonals in the table is obtained by detection, and the data in the blank can be obtained by calculation. The inversion compensation table is only a schematic table, which is not specifically limited in this disclosure.

For example, the process of calculating the third compensated grayscale value according to the first preceding grayscale value, the second subsequent grayscale value, the first compensated grayscale value and the second compensated grayscale value may comprise: calculating the third compensated grayscale value by using linear interpolation method according to the first preceding grayscale value, the first compensated grayscale value and the second compensated grayscale value.

For example, the first preceding grayscale value and the first subsequent grayscale value are H11, the first compensated grayscale value is H12, the second preceding grayscale value and the second subsequent grayscale value are H21, and the second compensated grayscale value is H22. At this time, when the non-diagonal region in FIG. 5 changes from the first preceding grayscale value H11 to the second subsequent grayscale value H12, the third compensated grayscale value H33 is calculated as follows:

$$H33=H11+k(H22-H12)$$

Among others, k is the compensation coefficient, and its value is obtained based on experience in practical applications.

The first compensated grayscale value corresponding to the first subsequent grayscale value is obtained by detection, and the third compensated grayscale value corresponding to the case of changing from the first preceding grayscale value to the second subsequent grayscale value is obtained by calculation. Thus, it is only required to detect the data in the diagonal region of the inversion compensation table, and the data outside the diagonal region, i.e., the third compensated grayscale value, can be obtained by calculation, thereby reducing the testing amount and easy to be implemented.

Figure 6:
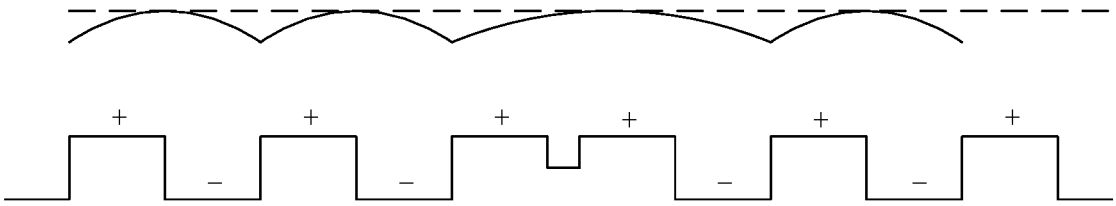
FIG. 6 is a schematic diagram of display brightnesses before and after an inversion operation according to an embodiment of the present disclosure.

Further, as shown in FIG. 6, before step S210, the above method for compensating the display voltage may further comprise: in step S250, receiving the polarity inversion signal, wherein the polarity inversion signal is used to indicate entering into a polarity inversion compensation mode.

Since the display flickering may be appeared in the screen after the inversion operation on the POL signal due to the overdriving, the method for compensating the display voltage according to the embodiments of the disclosure can be used for compensation when performing the inversion operation. In response to receiving the polarity control signal for controlling the polarity inversion, the method or apparatus enters into the inversion compensation mode, and obtains the compensated grayscale value according to the preceding grayscale value and the subsequent grayscale value.

After obtaining the compensated grayscale value, when displaying the subsequent frame after the above inversion operation, a pixel voltage of the pixel is compensated according to the compensated grayscale value of the arbitrary pixel.

For example, compensating a pixel voltage of the arbitrary pixel according to the compensated grayscale value may comprise: calculating the compensating value for the pixel voltage of the arbitrary pixel according to the compensated grayscale value, and compensating the pixel voltage of the arbitrary.

As shown in FIG. 6, the method for compensating the display voltage provided by the present disclosure compensates the pixel voltage of the pixel in the subsequent frame after the inversion operation, so that the compensated display brightness and the display brightness before the inversion operation are consistent. The problem of screen flicker caused by the inversion operation is solved.

It should be noted that in practical applications, the timing controller may comprise two compensation methods for processing data: a normal compensation and an inversion compensation.

During the normal compensation, a Vx1 receiver in a timing controller receives the data signal and decodes the data signal. Then the decoded data signal is processed by a digital gamma calibration module, a jitter processing module, and the compensation module, and then delivered to the line register, so as to wait for being output to the source line.

During the inversion compensation, the method or apparatus enters into the inversion compensation mode under the control of the polarity control signal, the Vx1 receiver receives the data signal and decodes the data signal. Then the decoded data signal is processed by digital gamma calibration, jitter processing, and compensation. Then, the micro-controller transmits the control signal to deliver the processed data signal to the inversion compensation module, which compensates the data signal according to the location of the subsequent grayscale value of the data signal in the inversion compensation table. Then, the data signal is delivered to the row register to wait for being output to the source line.

It should be noted that although the steps of the method in the present disclosure are described in a specific order in the drawings, this does not require or imply that the steps must be performed in the specific order, or all the steps shown must be performed, in order to achieve a desired result. Additionally or alternatively, some steps may be omitted, multiple steps may be combined into one step for execution, and/or one step may be decomposed into multiple steps for execution, and so on.

Figure 7:
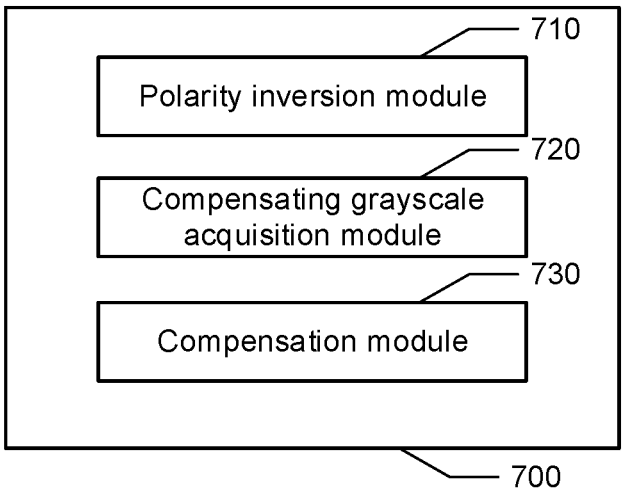
FIG. 7 is a block diagram illustrating an apparatus for compensating a display voltage according to an embodiment of the present disclosure.

Exemplary embodiments of the present disclosure also provide a display compensation apparatus. As shown in FIG. 7, the apparatus for compensating the display voltage 700 comprises:

a polarity inversion module 710, configured to invert a polarity inversion signal of an arbitrary pixel;

a compensating grayscale acquisition module 720, configured to acquire a preceding grayscale value and a subsequent grayscale value of the pixel. Among others, the polarity inversion signal is configured to control the polarity of the pixel voltage of the pixel, the preceding grayscale value is a grayscale value of the pixel in a preceding frame before the inversion operation, and the subsequent grayscale value is the grayscale value of the pixel in a subsequent frame after the inversion operation. Further, a compensated grayscale value is obtained from an inversion compensation table according to the preceding grayscale value and the subsequent grayscale value, wherein the inversion compensation table comprises a mapping relationship among the preceding grayscale value, the subsequent grayscale value and the compensated grayscale value.

The apparatus further comprises a compensating module 730, coupled to the compensating grayscale acquisition module 720 and configured to compensate, when displaying the subsequent frame after the inversion operation, a pixel voltage of the arbitrary pixel according to the compensated grayscale value.

The display compensation apparatus provided by an embodiment of the present disclosure comprises a compensating grayscale acquisition module 720 and a compensation module 730. The compensating grayscale acquisition module 720 acquires the compensated grayscale value from the inversion compensation table according to the preceding grayscale value and the subsequent grayscale value. The compensation module 730 compensates the pixel voltage by compensating the grayscale value. The problem, that there may be a screen flickering after the inversion operation of POL signal due to the brightness difference before and after the inversion operation under a static screen which is caused by the overdriving of the liquid crystal, can be solved. Further, because there is no change in the charging time, there will not be a problem of flickering at the distal end which is caused by insufficient charging at the distal end and well charging at the near end of the large-size panel, improving the display quality.

Figure 8:
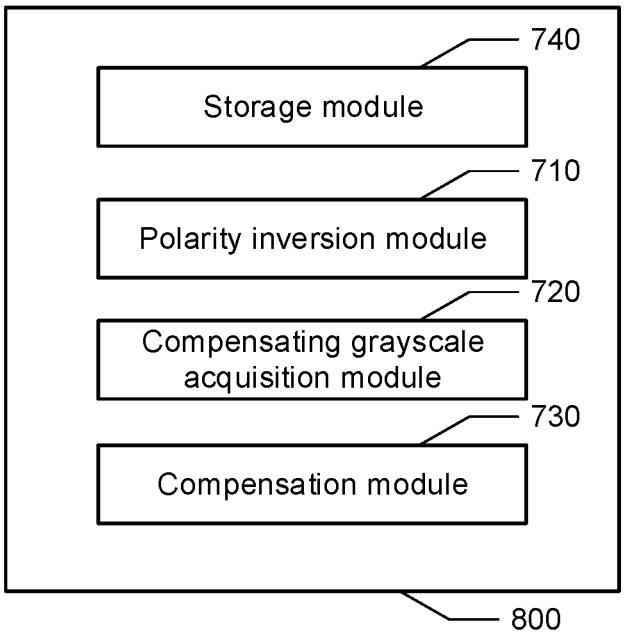
FIG. 8 is a block diagram illustrating an apparatus for compensating a display voltage according to another embodiment of the present disclosure.

Further, according to an embodiment of the present disclosure, as shown in FIG. 8, in addition to the polarity inversion module 710, the compensating grayscale acquisition module 720, and the compensation module 730 mentioned above, the apparatus for compensating the display voltage 800 may further comprise a storage module 740 coupled to the compensating grayscale acquisition module 720, and configured to store the inversion compensation table.

Figure 9:
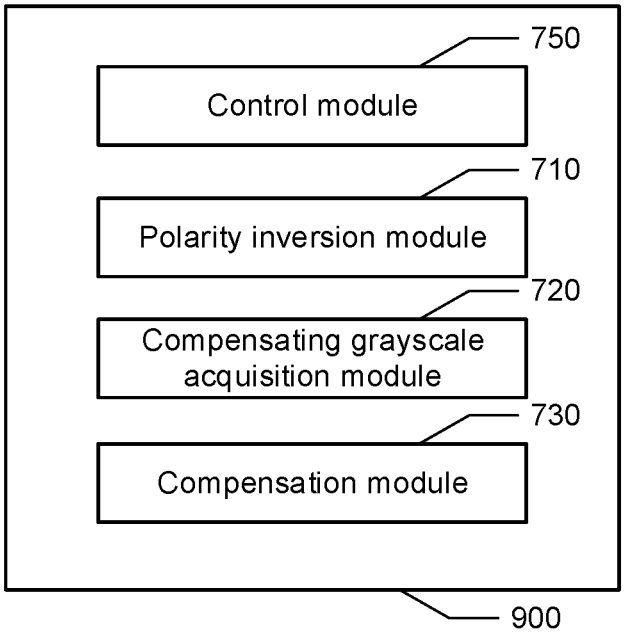
FIG. 9 is a block diagram illustrating an apparatus for compensating a display voltage according to yet another embodiment of the present disclosure.

Further, according to an embodiment of the present disclosure, as shown in FIG. 9, in addition to the polarity inversion module 710, the compensating grayscale acquisition module 720, and the compensation module 730 mentioned above, the apparatus for compensating the display voltage 900 may further comprise a control module 750 configured to receive the polarity control signal and control the compensating grayscale acquisition module 720 to obtain the compensated grayscale value in response to the polarity control signal.

Figure 10:
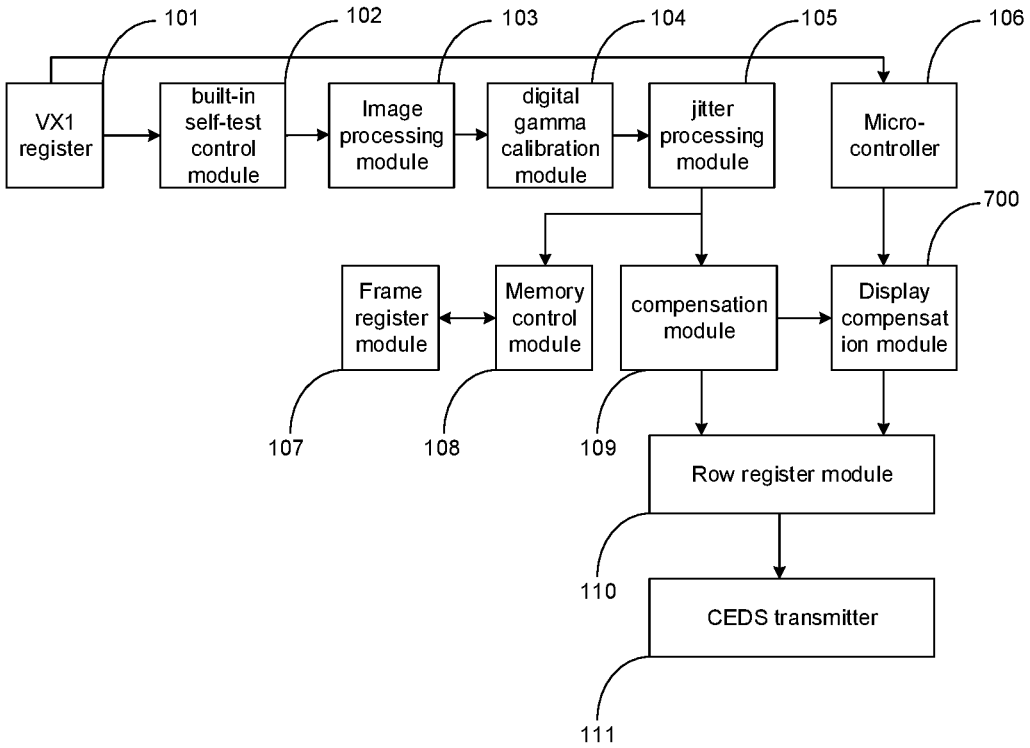
FIG. 10 is a schematic diagram illustrating a timing controller according to an embodiment of the present disclosure.

In practical applications, the apparatus for compensating the display voltage 700, 800, or 900 may be provided in the timing controller, as shown in FIG. 10, the timing controller may comprise a Vx1 receiver 101, a built-in self-test control module 102, an image processing module 103, a digital gamma calibration module 104, a jitter processing module 105, a compensation module 109, a memory control module 108, a frame register module 107, a micro-controller 106, a row register module 110 and a Clock Embedded Differential Signaling (CEDS) transmitter 111 and so on. The timing controller may comprise two compensation methods for processing data: a normal compensation and an inversion compensation.

During the normal compensation, a Vx1 receiver 101 in a timing controller receives the data signal and decodes the data signal. Then the decoded data signal is processed by a digital gamma calibration module 104, a jitter processing module 105, and the compensation module 109, and then delivered to the row register 110, so as to wait for being output to the source line via the CEDS transmitter 111.

During the inversion compensation, the method or apparatus enters into the inversion over compensation mode under the control of the polarity control signal, the Vx1 receiver 101 receives the data signal and decodes the data signal. Then the decoded data signal is processed by the digital gamma calibration module 104, the jitter processing module 105, and the compensation module 109. Then, the micro-controller 106 transmits the control signal to deliver the processed data signal to the display compensation apparatus 700, which compensates the data signal according to the location of the subsequent grayscale value of the data signal in the inversion compensation table. Then, the data signal is delivered to the row register 110 to wait for being output to the source line via the CEDS transmitter 111.

The detailed description of each module in the above virtual display compensation apparatus have been made in detail in the corresponding virtual transmission method, and will not be discussed in detail.

It should be noted that although several modules or units of the display compensation apparatus are mentioned in the above detailed description, such a division is not mandatory. In fact, according to the embodiments of the present disclosure, the features and functions of the two or more modules or units described above may be embodied in one module or unit. Conversely, the features and functions of one module or unit described above can be further divided into a plurality of modules or units.

Figure 11:
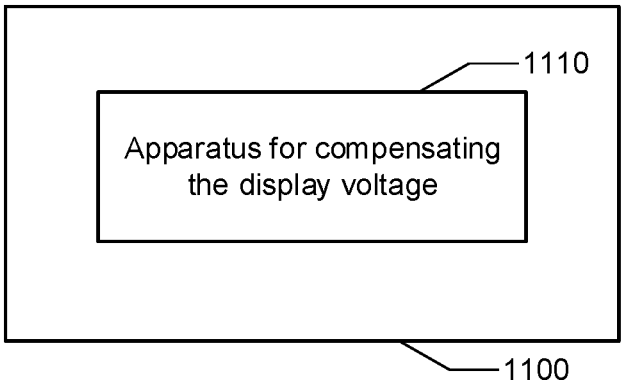
FIG. 11 is a block diagram of a display apparatus according to an embodiment of the present disclosure.

The embodiments of the present disclosure further provide a display apparatus. FIG. 11 is a block diagram of the display apparatus according to an embodiment of the present disclosure; and As shown in FIG. 11, the display apparatus 1100 may comprise a display voltage 440 compensation apparatus 1110 and the apparatus for compensating the display voltage 1110 may be the apparatus for compensating the display voltage 700, 800 or 900 described above. Since the apparatus for compensating the display voltage 700, 800 or 900 have been described in detail above, the description will not be repeated here. Of course, in practical applications, the display apparatus may further comprise: a pixel circuit, a backlight module, a display module, etc., wherein the description thereof will be omitted in the embodiments of the present disclosure since they all belong to prior art. The display apparatus may comprise any product or component having a display function, such as, a television set, an electronic paper, a mobile phone, a tablet computer, a TV, a notebook computer, a digital photo frame, a navigator, or the like.

Figure 12:
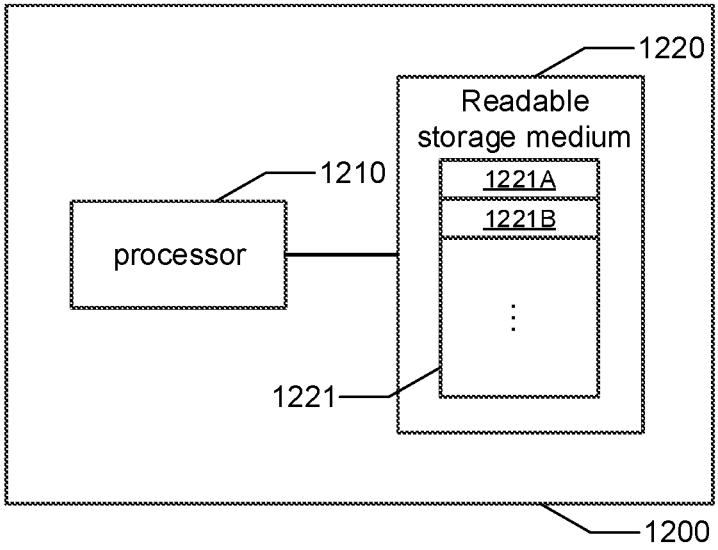
FIG. 12 is a block diagram of a display device according to an embodiment of the present disclosure.

FIG. 12 schematically shows a block diagram of a display device suitable for implementing the method described above according to an embodiment of the present disclosure. The display device shown in FIG. 12 is only an example, and should not bring any limitation to the functions and application scope of the embodiments of the present disclosure.

As shown in FIG. 12, the display device 1200 comprises one or more processors 1210 and a computer-readable storage medium 1220. The display device 1200 may perform the method according to the embodiment of the present disclosure.

For example, the processor 1210 may comprise, for example, a general-purpose microprocessor, an instruction set processor and/or related chipsets, and/or a dedicated microprocessor (for example, an application specific integrated circuit (ASIC)), and so on. The processor 810 may also comprise on-board memory for caching purposes. The processor 1210 may be a single processing unit or multiple processing units for performing different actions of the methodological flow according to the embodiments of the present disclosure.

The computer-readable storage medium 1220 may be, for example, a non-volatile computer-readable storage medium, and its specific examples comprise but are not limited to: magnetic storage devices such as magnetic tapes or hard disks (HDD); optical storage devices such as optical disks (CD-ROM); memories such as random access memory (RAM) or flash memory; and so on.

The computer-readable storage medium 1220 may comprise a computer program 1221 comprising code/computer-executable instructions, which when executed by the processor 1210 cause the processor 1210 to perform the method according to an embodiment of the present disclosure or any variation thereof.

The computer program 1221 may be configured to have, for example, computer program code comprising computer program modules. For example, in an example embodiment, the code in the computer program 1221 may comprise one or more program modules, comprising, for example, module 1221A, module 1221B, It should be noted that the division and number of modules are not fixed, those skilled in the art may use appropriate program modules or program module combinations according to actual conditions. These program module combinations, when executed by the processor 1210, may cause the processor 1210 to implement the method according to an embodiment of the present disclosure or any variant thereof.

The present disclosure also provides a computer-readable storage medium. The computer-readable storage medium may be comprised in the device/apparatus/system described in the above embodiments; or may exist alone without being assembled into the device/apparatus/system. The above computer-readable storage medium may carry one or more programs, and when the above one or more programs are executed, the method according to an embodiment of the present disclosure may be implemented.

According to an embodiment of the present disclosure, the computer-readable storage medium may be a non-volatile computer-readable storage medium, which may comprise but is not limited to a portable computer disk, a hard disk, a random access memory (RAM), a read-only memory (ROM), an erasable programmable read-only memory (EPROM or flash memory), a portable compact disk read-only memory (CD-ROM), an optical storage device, a magnetic storage device, or any suitable combination of the above. In the present disclosure, the computer-readable storage medium may be any tangible medium that contains or stores a program, and the program may be used by or in combination with an instruction execution system, apparatus, or device.

Those skilled in the art can understand that various aspects of the present disclosure can be implemented as a system, method, or program product. Therefore, various aspects of the present disclosure may be specifically implemented in the form of a pure hardware embodiment, a pure software embodiment (comprising firmware, microcode, etc.), or a combination thereof, which may be collectively referred to "circuit", "module" or "system" herein.

In addition, the above-mentioned drawings are only schematic illustrations of processes comprised in the method according to the exemplary embodiment of the present disclosure, and are not intended to limit the purpose. It should be understood that the processes shown in the above drawings do not indicate or limit the chronological order of these processes. In addition, it should also be understood that these processes may be performed synchronously or asynchronously in multiple modules, for example.

Those skilled in the art will easily conceive other embodiments of the present disclosure after reviewing the specification and practicing the disclosure disclosed herein. This application is intended to cover any variations, uses, or adaptive changes of the present disclosure that follow the general principles of the present disclosure and comprise common general knowledge or customary technical means in the technical field which is not disclosed in the present disclosure. The description and examples are to be considered exemplary only, and the true scope and spirit of this disclosure are indicated by the claims.

It should be understood that the present disclosure is not limited to the precise structure that has been described above and shown in the drawings, and various modifications and changes can be made without departing from the scope thereof. The scope of the present disclosure is defined only by the appended claims.

The invention claimed is:

1. A method for compensating a display voltage, comprising:

acquiring, when performing an inversion operation with a polarity inversion signal for an arbitrary pixel, a preceding grayscale value and a subsequent grayscale value of the pixel, wherein the polarity inversion signal is configured to control the polarity of the pixel voltage of the pixel, the preceding grayscale value is a grayscale value of the pixel in a preceding frame before the inversion operation, and the subsequent grayscale value is the grayscale value of the pixel in a subsequent frame after the inversion operation;

obtaining a compensated grayscale value from an inversion compensation table according to the preceding grayscale value and the subsequent grayscale value, wherein the inversion compensation table comprises a mapping relationship among the preceding grayscale value, the subsequent grayscale value and the compensated grayscale value; and compensating, when displaying the subsequent frame, a pixel voltage of the pixel according to the compensated grayscale value;

wherein the method further comprises constructing the inversion compensation table; the constructing the inversion compensation table comprises:

obtaining a first preceding grayscale value and a first subsequent grayscale value of the pixel which are the same;

detecting a first standard brightness to which the first preceding grayscale value is directed and a first display brightness to which the first subsequent grayscale value is directed, respectively;

comparing the first display brightness with the first standard brightness;

reducing, when the first display brightness is greater than the first standard brightness, the first subsequent grayscale value, and using a reduced first subsequent grayscale value as a first compensated grayscale value, wherein the display brightness to which the first compensated grayscale value is directed is less than or equal to the first standard brightness;

obtaining a second preceding grayscale value and a second subsequent grayscale value of the pixel which are the same;

detecting a second standard brightness to which the second preceding grayscale value is directed and a second display brightness to which the second subsequent grayscale value is directed, respectively;

comparing the second display brightness with the second standard brightness;

reducing, when the second display brightness is greater than the second standard brightness, the second subsequent grayscale value, and using a reduced second subsequent grayscale value as a second compensated grayscale value, wherein the display brightness to which the second compensated grayscale value is directed is less than or equal to the second standard brightness;

calculating a third compensated grayscale value for the first preceding grayscale value and the second subsequent grayscale value, according to the first preceding grayscale value, the first compensated grayscale value, the second subsequent grayscale value and the second compensated grayscale value; and constructing the inversion compensation table, according to the first preceding grayscale value, the second subsequent grayscale value and the third compensated grayscale value.

2. The method of claim 1, wherein calculating the third compensated grayscale value for the first preceding grayscale value and the second subsequent grayscale value, according to the first preceding grayscale value, the first compensated grayscale value, the second subsequent grayscale value and the second compensated grayscale value comprises:

calculating the third compensated grayscale value by using linear interpolation method according to the first preceding grayscale value, the first compensated grayscale value and the second compensated grayscale value.

3. The method of claim 1, further comprising:

receiving the polarity inversion signal, and entering into a polarity inversion compensation mode in response to the polarity inversion signal, before obtaining the compensated grayscale value from the inversion compensation table according to the preceding grayscale value and the subsequent grayscale value.

4. A display device, comprising:

a memory configured to store instructions;

at least one processor, wherein the at least one processor is configured to execute the instructions stored in the memory to implement the method according to claim 1.

* * * * *